US007270408B2

(12) United States Patent
Odell et al.

(10) Patent No.: US 7,270,408 B2
(45) Date of Patent: Sep. 18, 2007

(54) LOW LEVEL CURE TRANSFUSE ASSIST FOR PRINTING WITH RADIATION CURABLE INK

(75) Inventors: Peter G. Odell, Mississauga (CA); Adela Goredema, Mississauga (CA); Evonne Kwok, Kakinada (IN)

(73) Assignee: Xerox Corporation, Stamford, CT (US)

( * ) Notice: Subject to any disclaimer, the term of this patent is extended or adjusted under 35 U.S.C. 154(b) by 330 days.

(21) Appl. No.: 11/034,850

(22) Filed: Jan. 14, 2005

(65) Prior Publication Data

US 2006/0158496 A1 Jul. 20, 2006

(51) Int. Cl.
*B41J 2/01* (2006.01)

(52) U.S. Cl. ..... 347/102; 347/103

(58) Field of Classification Search ..... 347/100, 347/95, 96, 101, 102, 105, 103; 106/31.27, 106/31.6, 31.13; 523/160
See application file for complete search history.

(56) References Cited

U.S. PATENT DOCUMENTS

| | | | | |
|---|---|---|---|---|
| 4,836,102 | A | 6/1989 | Cicci | |
| 5,623,001 | A * | 4/1997 | Figov | 347/102 |
| 5,641,346 | A | 6/1997 | Mantell et al. | |
| 6,259,880 | B1 | 7/2001 | Jia et al. | |
| 6,318,853 | B1 * | 11/2001 | Asano et al. | 347/103 |
| 6,354,700 | B1 | 3/2002 | Roth | |
| 6,536,889 | B1 | 3/2003 | Biegelsen et al. | |
| 6,561,640 | B1 | 5/2003 | Young | |
| 2001/0031344 | A1 | 10/2001 | Nordeen et al. | |
| 2003/0081096 | A1 * | 5/2003 | Young | 347/102 |
| 2004/0132862 | A1 * | 7/2004 | Woudenberg | 523/160 |
| 2004/0160499 | A1 | 8/2004 | Ishikawa | |

FOREIGN PATENT DOCUMENTS

| | | |
|---|---|---|
| GB | 2 322 597 | 9/1998 |

OTHER PUBLICATIONS

The Printing Ink Manual, Fourth Edition, by Dr. R.H. Leach (1988) (Table of contents; Chapter 2 , p. 54-57 & Chapter 11, p. 566-571).*
The Printing Ink Manual, Fifth Edition, by Dr. R.H. Leach (1993) Chapters 8-10.*
U.S. Appl. No. 11/034,714, filed Jan. 14, 2005, Belelie et al.
U.S. Appl. No. 11/034,856, filed Jan. 14, 2005, Odell et al.
U.S. Appl. No. 11/034,257, filed Jan. 13, 2005, Odell et al.
English Language Version of European Search Report.

* cited by examiner

*Primary Examiner*—Manish S. Shah
(74) *Attorney, Agent, or Firm*—Oliff & Berridge, PLC

(57) ABSTRACT

The method of forming an image formed of low viscosity ink on a recording medium includes ejecting the low viscosity ink from a printer head in the form of droplets onto an intermediate transfer medium to form the image, partially curing the image on the intermediate transfer medium, transferring the partially cured image onto the recording medium, and further curing the partially cured image on the recording medium to create a hardened image.

19 Claims, No Drawings

LOW LEVEL CURE TRANSFUSE ASSIST FOR PRINTING WITH RADIATION CURABLE INK

BACKGROUND OF THE INVENTION

1. Field of Invention

The present invention is directed to methods of assisting in the transfer of images from an intermediate transfer medium to a recording medium. In particular, radiative energy is used to partially cure low viscosity inks to assist in the transfer of images from the intermediate transfer medium to the recording medium during the transfer of the ink from the intermediate transfer medium to the recording medium during the printing process.

2. Description of Related Art

The volume of digital color printing is expected to experience significant growth in the coming years. The color images provided by ink jet printing using solid inks are overwhelmingly preferred in panel studies over other digital imaging systems. There is also a strong case to be made that the total cost of ownership of an ink jet printer will ultimately be cheaper than similar volume electrophotography units. Transfuse plays an important role in piezoelectric ink jet printers by enabling a high quality image to be built up on a rapidly rotating transfer member.

In a typical ink jet printer, the image is applied during four to six rotations with a small translation of the print head in between. This approach simplifies the print head design, while the small movements of the head ensures good droplet registration. The hot melt ink typically used with ink jet printers, e.g., a crystalline wax ink, partially cools on the intermediate transfer member such as a drum or belt and is pressed into the image receiving medium such as paper. This step spreads the image droplet providing a richer color and lower pile height. The low flow of the solid ink prevents show through on the paper.

The current hot melt ink designs work well in transfuse because of the thermally driven changes in rheology. However, the crystalline wax inks do not provide robust images on the paper.

One example of an image transferring method using temperature gradients, e.g., heat, is disclosed in U.S. Pat. No. 6,259,880 to Jia et al.

In particular, the inks currently used in piezoelectric ink jet printers are wax based and are jetted onto a transfuse member, for example, an aluminum drum at temperatures of approximately 130-140° C. The wax based inks are heated to such high temperatures to decrease their viscosity for more efficient jetting onto the transfuse member. The transfuse member is heated to approximately 60° C., so that the wax will cool and thus solidify or crystallize. As the transfuse member rolls over the recording medium, e.g., paper, the image comprised of wax based ink is pressed into the paper.

One problem of the wax based ink is that the inks are soft and scratch easily. Wax based inks generally crystallize at temperatures greater than room temperature. Therefore, the wax based ink that has been transferred to the recording medium is essentially as hard as it will get.

Another problem of using wax based inks that crystallize is that the use of a low viscosity oil, such as silicon oil, on an intermediate transfer member is necessary. The oil is used to release the ink located on the transfer member so the image can be pulled off the transfer member onto the recording medium, e.g., paper. Without the oil, part of the ink would remain on the transfer member. However, a small portion of the oil will be transferred onto the recording medium. Any oil transferred onto the recording medium is quickly diffused. However, until the oil has been diffused it is not possible to write on the recording medium.

Thus, curing by photoinitiation of reactive inks is of interest because ink cured in such a manner provides tough, permanent images on paper. These photocurable inks can be designed to have low viscosity and avoid the need to heat the print head beyond what may be required for thermal stability.

However, a low viscosity ink is difficult to transfuse because the ink droplets may coalesce during transfer member rotation and additionally the low viscosity ink will show through the paper. There are two shortcomings with low viscosity inks: (1) coalescence may occur, for example, a row of five closely spaced drops might merge into a single blob, and (2) show through occurs when the low viscosity ink wicks through the paper to become noticeable on the opposite side rather than sitting on the surface it was printed on.

Further, low viscosity ink, such as radiation curable ink, does not hold its location well on the transfuse member and is therefore not currently the preferred ink in an ink jet printer such as a piezoelectric printer or an acoustic ink jet printer.

The drops of the low viscosity ink tend to run together when transferred onto the recording medium. Also, the final image may be hazy, feathered, and may show through on the other side of the recording medium.

SUMMARY OF THE INVENTION

Therefore, a method to transfer ink onto a recording medium that has a final hard and well-adhered image is desired and is one object of the present invention.

Thus, one embodiment of the present invention is a process that includes partially treating a radiation curable ink with radiation or an electron beam to polymerize and harden the ink during the transfer process. By partially curing the ink on the intermediate transfer medium, such as a transfuse drum or transfuse belt, the partial cure increases the viscosity and therefore prevents droplet coalescence and image show through. Once transferred to the recording medium, the image can undergo a final cure to achieve a hard, well-adhered image.

Another benefit of the present invention is that the use of a low viscosity oil is not necessary for the image formed on the transfuse drum or transfuse belt to be transferred onto the recording medium as described herein. By not requiring the use of an oil, the printer is simplified and it is possible to write on the recording medium immediately after the image has been transferred.

DETAILED DESCRIPTION OF PREFERRED EMBODIMENTS

Low viscosity ink, as used herein, refers to a radiation curable ink that has a viscosity between 5 and 20 cP, preferably between 8 and 13 cP, and most preferably approximately 11 cP when the print heads are heated to a temperature between about 25° C. to about 60° C.

Low viscosity inks such as radiation curable inks tend to coalesce on the intermediate transfer medium, such as a transfuse drum or transfuse belt, and this coalescence leads to a loss of image resolution because several individual drops become one. Additionally, the low viscosity ink may show through the recording medium leading to a loss of optical density on the printed surface and an undesired increase in optical density of the image on the reverse side of the medium. Low viscosity ink preferably refers to radiation curative ink, such as electron beam curable ink or UV curable ink, and more preferably refers to UV curable ink.

The recording medium can be any medium which can be printed on, including clothing and plastic, but most preferably is paper.

The printer can be any type of ink jet printer including a thermal ink jet, acoustic ink jet or piezoelectric ink jet printer, but most preferably a piezoelectric ink jet printer or an acoustic ink jet printer.

When using a piezoelectric ink jet printer, the temperature of the print head is preferably maintained between about 25° C. and about 60° C. to achieve a preferable jetting viscosity of the low viscosity curable ink. If the temperature greatly exceeds the preferred range, the low viscosity curable ink may begin to polymerize and harden. If this occurs, the ink will thicken, and will not be properly ejected from the print head. If the temperature is too low, the ink may be too thick for jetting and may potentially clog the jets.

The required ink formulation comprises a monomer, a photoinitiator and a colorant. The low viscosity ink can also comprise an oligomer if the ink is cured by UV radiation.

Examples of monomers used in the composition of low viscosity ink include propoxylated neopentyl glycol diacrylate, diethylene glycol diacrylate, triethylene glycol diacrylate, hexanediol diacrylate, dipropyleneglycol diacrylate, tripropylene glycol diacrylate, alkoxylated neopentyl glycol diacrylate, isodecyl acrylate, tridecyl acrylate, isobornyl acrylate, propoxylated trimethylolpropane triacrylate, ethoxylated trimethylolpropane triacrylate, di-trimethylolpropane tetracarylate, dipentaerythritol pentacarylate, ethoxylated pentaerythritol tetraacrylate.

Common oligomers that may be used in the composition of the low viscosity curable ink include oligomers produced by Sartomer Company, Exton Pa.; BASF, Charlotte, N.C.; Cognis Corporation, Cincinnati, Ohio; Cytec Industries Inc., West Paterson, N.J. (formerly UCB Surface Specialties), Rahn, Aurora, Ill. There are three major classes of oligomeric acrylates: epoxy, polyester and polyurethane. Furthermore, epoxy acrylates are often amine functionalized to act as synergists with Type 2 initiation schemes. Of particular utility in inks are oligomers with low viscosity of less than 1000 cP. These oligomers include Ebecryl 812 (ex UCB); PO 83 F, PO94 F, and PO 33 F ex BASF; Photomer 4967 and Photomer 5429 ex Cognis; CN292, CN2204, CN131 B, CN984 and CN384 ex Sartomer; Genomer 3364 and Genomer 3497 ex Rahn.

Examples of photoinitiators used in the composition of low viscosity ink include 1-hydroxy-cyclohexylphenylketone, benzophenone, 2-benzyl-2-(dimethylamino)-1-(4-(4-morphorlinyl)phenyl)-1-butanone, 2-methyl-1-(4-methylthio)phenyl-2-(4-morphorlinyl)-1-propanone, diphenyl-(2,4,6-trimethylbenzoyl) phospine oxide, phenyl bis(2,4,6-trimethylbenzoyl) phosphine oxide, benzyl-dimethylketal, isopropylthioxanthone. This list is not exhaustive; any known photoinitiator that can be used in the composition of a low viscosity ink can be used.

The inks also preferably include a colorant, e.g., a pigment or dye. As the dye or pigment colorant media, any suitable dye or pigment may be used without limitation so long as the colorant is dispersible within the ink vehicle. Examples of suitable pigments include Violet Toner VT-8015 (Paul Uhlich); Paliogen Violet 5100 (BASF); Paliogen Violet 5890 (BASF); Permanent Violet VT 2645 (Paul Uhlich); Heliogen Green L8730 (BASF); Argyle Green XP111-S (Paul Uhlich); Brilliant Green Toner GR 0991 (Paul Uhlich); Lithol Scarlet D3700 (BASF); Solvent Red 49; Pigment red 57:1; Toluidine Red (Aldrich); Scarlet for Thermoplast NSD PS PA (Ugine Kuhlmann of Canada); E.D. Toluidine Red (Aldrich); Lithol Rubine Toner (Paul Uhlich); Lithol Scarlet 4440 (BASF); Bon Red C (Dominion Color Company); Royal Brilliant Red RD-8192 (Paul Uhlich); Oracet Pink RF (Ciba-Geigy); Paliogen Red 3871K (BASF); Paliogen Red 3340 (BASF); Lithol Fast Scarlet L4300 (BASF); Solvent Blue 808; Heliogen Blue L6900, L7020 (BASF); Heliogen Blue K6902, K6910 (BASF); Heliogen Blue D6840, D7080 (BASF); Sudan Blue OS (BASF); Neopen Blue FF4012 (BASF); PV Fast Blue B2G01 (American Hoechst); Irgalite Blue BCA or Irgalite Blue NGA (Ciba-Geigy); Paliogen Blue 6470 (BASF); Sudan II (Red Orange) (Matheson, Colemen Bell); Sudan II (Orange) (Matheson, Colemen Bell); Sudan Orange G (Aldrich), Sudan Orange 220 (BASF); Paliogen Orange 3040 (BASF); Ortho Orange OR 2673 (Paul Uhlich); Solvent Yellow 162; Paliogen Yellow 152, 1560 (BASF); Lithol Fast Yellow 0991 K (BASF); Paliotol Yellow 1840 (BASF); Novopern Yellow FGL (Hoechst); Permanent Yellow YE 0305 (Paul Uhlich); Lumogen Yellow D0790 (BASF); Suco-Yellow L1250 (BASF); Suco-Yellow D1355 (BASF); Suco Fast Yellow D1355, D1351 (BASF); Hansa bril yellow SGX 03(B); Hostaperm Pink E (American Hoechst); Fanal Pink D4830 (BASF); Cinquasia Magenta (Du Pont); Paliogen Black L0084 (BASF); Pigment Black K801 (BASF); and carbon blacks such as REGAL 330.®. (Cabot), Carbon Black 5250, Carbon Black 5750 (Columbia Chemical), and the like. Examples of suitable dyes include Pontomine; Food Black 2; Carodirect Turquoise FBL Supra Conc. (Direct Blue 199), available from Carolina Color and Chemical; Special Fast Turquoise 8 GL Liquid (Direct Blue 86), available from Mobay Chemical; Intrabond Liquid Turquoise GLL (Direct Blue 86), available from Crompton and Knowles; Cibracron Brilliant Red 38-A (Reactive Red 4), available from Aldrich Chemical; Drimarene Brilliant Red X-2B (Reactive Red 56), available from Pylam, Inc.; Levafix Brilliant Red E4B, available from Mobay Chemical; Levafix Brilliant Red E6-BA, available from Mobay Chemical; Procion Red H8B (Reactive Red 31), available from ICI America; Pylam Certified D&C Red #28 (Acid Red 92), available from Pylam; Direct Brill Pink B Ground Crude, available from Crompton and Knowles; Cartasol Yellow GTF Presscake, available from Sandoz, Inc.; Tartrazine Extra Conc. (FD&C Yellow #5, Acid Yellow 23), available from Sandoz, Inc.; Carodirect Yellow RL (Direct Yellow 86), available from Carolina Color and Chemical; Cartasol Yellow GTF Uquid Special 110, available from Sandoz, Inc.; D&C Yellow #10 (Acid Yellow 3), available from Tricon; Yellow Shade 16948, available from Tricon; Basocid Black×34, available from BASF; Carta Black 2GT, available from Sandoz, Inc.; and the like. Particularly preferred are solvent dyes; within the class of solvent dyes, spirit soluble dyes are preferred because of their compatibility with the ink vehicles of the present invention. Examples of suitable spirit solvent dyes include Neozapon Red 492 (BASF); Orasol Red G (Ciba-Geigy); Direct Brilliant Pink B (Crompton & Knowles); Aizen Spilon Red C-BH (Hodogaya Chemical); Kayanol Red 3BL (Nippon Kayaku); Levanol Brilliant Red 3BW (Mobay Chemical); Levaderm Lemon Yellow (Mobay Chemical); Spirit Fast Yellow 3G; Aizen Spilon Yellow C-GNH (Hodogaya Chemical); Sirius Supra Yellow GD 167; Cartasol Brilliant Yellow 4GF (Sandoz); Pergasol Yellow CGP (Ciba-Geigy); Orasol Black RLP (Ciba-Geigy);

Savinyl Black RLS (Sandoz); Dermacarbon 2GT (Sandoz); Pyrozol Black BG (ICI); Morfast Black Conc. A (Morton-Thiokol); Diaazol Black RN Quad (ICI); Orasol Blue GN (Ciba-Geigy); Savinyl Blue GLS (Sandoz); Luxol Blue MBSN (Morton-Thiokol); Sevron Blue 5GMF (ICI); Basacid Blue 750 (BASF), and the like. Neozapon Black X51 [C.I. Solvent Black, C.I. 12195] (BASF), Sudan Blue 670 [C.I. 61554] (BASF), Sudan Yellow 146 [C.I. 12700] (BASF), and Sudan Red 462 [C.I. 260501] (BASF) are preferred.

The ink according to one embodiment undergoes a radical curing technique. This means the ink is capable of absorbing radiation and producing free radicals that initiate free radical polymerization of the polymerizable compounds, causing the ink to cure and harden.

The component of the ink that usefully absorbs radiation is the photoinitiator. This absorption of a photon of light promotes an electron from a low energy orbital to a high energy orbital within the photoinitiator molecule. The molecule with an electron in a high energy orbital is in its excited state. From this excited state various pathways can be followed. There are three typical pathways that are useful to effecting cure of the ink. All three pathways ultimately result in the production of a free radical that can react with the carbon-carbon double bond of the acrylate groups found in other ink components.

The three pathways for the excited photoinitiator molecule are: (1) direct fragmentation via homolytic bond cleavage to produce at least one radical of sufficient energy to initiate acrylate polymerization, (2) a bimolecular reaction where the excited molecule abtracts a hydrogen atom from another differently structured molecule and this second molecule initiates acrylate polymerization, and (3) the excited molecule transfers its energy to another differently structured molecule which then initiates polymerization.

Often several photoinitiators are used to most efficiently harvest the light energy supplied by the UV light source. For instance the phosphine oxide class of photoinitiators, such as diphenyl-(2,4,6-trimethylbenzoyl) phosphine oxide, are known to be very light sensitive and absorb at longer wavelengths of light, up to about 400 nm. These properties make this class of photoinitiators useful in pigmented inks because they absorb light where pigments often have little absorption (~400 nm) and their sensitivity allow these photoinitiators to initiate polymerization deep in a pigmented ink where little light has penetrated. Initiators with these properties are said to be useful for depth cure. However, the phosphine oxides do not efficiently initiate polymerizations in the presence of oxygen. Oxygen is known to interfere with free radical reactions. UV curing systems typically have sufficiently high levels of photoinitiator that there is enough to consume the oxygen present and initiate the polymerization. The difficulty arises when fresh oxygen can diffuse to the active free radical polymerization and slow or stop it. These conditions are most likely to occur at the surface of an ink or coating when the irradiation takes place in air.

Other photoinitiator systems are used to overcome the presence of higher levels of oxygen near the surface of the coating. Examples of photoinitiators that function well near the surface are 2-methyl-1-(4-methylthio)phenyl-2-(4-morphorlinyl)-1-propanone or the combination of isopropylthioxanthone or benzophenone and a suitable amine functionality such as the oligomer PO94 F from BASF or small molecule amines such as ethyl 4-(dimethylamino)benzoate. Such photoinitiators systems as these are said to be effective for surface curing.

The photoinitiators initiate the polymerization of activated carbon-carbon double bonds to form chains of single bonds. Activation of carbon-carbon double bonds to free radical polymerization is generally achieved through conjugation with other double bonds such as occurs with acrylate, methacrylate and styrenic groups. Styrene derivatives often have other photochemical pathways available to them that interfere with the desired polymerization or curing of the ink.

Methacrylate groups offer good mechanical properties upon cure but are typically slower to polymerize than acrylate groups. Thus, for rapidly curing inks for use in high speed printers, acrylate functionality is preferred as the predominate type of reactive group. The monomers and oligomers are chosen to provide good properties upon cure, rapid polymerization, low viscosity for jetting, and safe handling.

The print head ejects droplets of ink onto the transfuse drum at the proper locations to form the image. The transfuse drum may have a thin coating of low viscosity oil such as silicon oil applied to it. However, this oil is not necessary to the efficacy of the various embodiments of the present invention.

Once the print head has ejected the droplets of ink in a thin layer onto the transfuse drum or transfuse belt to form the image, a partial curing of the image formed on the transfer medium occurs. This is done by treating the formed image with radiative energy.

The radiative energies used to partially cure the images formed on the transfuse drum or transfuse belt are UV A (315-400 nm) 0.2 to 0.8 w/cm$^2$, UV B (280-315 nm) 0.3 to 1.0 w/cm$^2$ and UV C (200-280 nm) 0.05 to 0.5 w/cm$^2$, preferably UV A (315400 nm) 0.3 to 0.6 w/cm$^2$, UV B (280-315 nm) 0.4 to 0.7 w/cm$^2$ and UV C (200-280 nm) 0.05 to 0.3 w/cm$^2$, and most preferably UV A (315-400 nm) approximately 0.5 w/cm$^2$, UV B (280-315 nm) approximately 0.6 w/cm$^2$ and UV C (200-280 nm) approximately 0.1 w/cm$^2$. The ink on the transfuse drum or transfuse belt is exposed to the radiation for approximately 1 second, or the required amount of time to achieve the desired viscosity.

The use of UV A, UV B and UV C as radiative energy is well known to practitioners in the art. Therefore, it is not necessary to provide further instruction on the use of such energy.

After an appropriate exposure to the radiation energy, the ink has been partially cured on the transfer medium. The partially cured ink preferably is cured to a point where it has a high enough viscosity that it will not coalesce while the transfuse drum or transfuse belt is rotating. Further, due to its higher viscosity, the partially cured ink will not show through the recording medium once it has been transferred.

Multiple color inks may be simultaneously jetted onto the transfer medium. If multiple color inks are simultaneously jetted onto the transfer medium, different photoinitiators may be used to influence the amount of time the ink needs to be treated with radiative energy. This allows the partial curing of all differently colored inks to occur at the same time for the same duration of time. Even with multiple colors, partial curing occurs after all of the ink has been jetted onto the transfer medium.

Once the ink has been partially cured on the transfer medium, it is transferred onto the recording medium. An oil, if used, provides a weak link between the transfer medium and the formed image. The oil acts as a releasing agent for the partially cured image located on the transfer medium. This means that when the image is transferred to the recording medium, the oil will split and the image will fully transfer onto the recording medium without leaving any remnants of ink on the transfuse drum.

Once the ink, i.e., the image, has been transferred onto the recording medium, the ink is again cured. The radiative energies used to completely cure and harden the images on the recording medium are UV A (314-400 nm) 0.8 to 2.0 w/cm$^2$, UV B (280-315 nm) 0.5 to 1.8 w/cm$^2$ and UV C (200-180 nm) 0.05 to 0.6 w/cm$^2$, preferably UV A (314-400 nm) 1.0 to 1.8 w/cm$^2$, UV B (280-315 nm) 0.7 to 1.6 w/cm$^2$ and UV C (200-180 nm) 0.1 to 0.4 w/cm$^2$, and most preferably UV A (314-400 nm) 1.3-1.5 w/cm$^2$, UV B (280-315 nm) 1.0-1.4 w/cm$^2$ and UV C (200-180 nm) 0.15-0.28 w/cm$^2$. The ink on the recording medium is exposed to the radiation for approximately 2 seconds, or the required amount of time to achieve the hardened, well-adhered image. After appropriate exposure to the radiation energy, the ink is completely cured on the recording medium, i.e., the ink is hardened and the viscosity becomes so high as to be inconsequential and/or immeasurable.

The invention will now be further illustrated by way of the following examples. These Examples are only illustrative and are not intended to limit the scope of the present invention. The Examples were not performed using a printer but were instead tested using correlating machines to analyze the efficacy of curing the ink on a transfuse drum. The Examples could have been performed with substantially identical results on a piezoelectric printer or an acoustic ink jet printer.

EXAMPLE 1

A transfuse sheet was prepared by coating a 1.7 cm×21.59 cm aluminum sheet with a low viscosity oil. A thin coating was achieved by spreading the oil over the entire surface and then placing a second aluminum sheet over the first and then splitting the sandwiched sheets. A sheet of "uncoated" xerographic paper was then pressed onto each aluminum sheet to blot the excess oil.

An ink was made combining 10.14 g of propoxylated neopentyl glycol diacrylate, 1.95 g of amine modified polyether acrylate, 0.65 g of 2-benzyl 2-dimethylamino 1-(4-morpholinophenyl) butanone-1, and a dye, in this case 0.26 g Neopen Blue 807.

The ink was imaged onto the oiled aluminum sheet using a K Printing Proofer (R. K. Print-Coat Instrument LTD.) employing a 3 wedge Gravure plate 60 lines per cm, density 100, 80, 60%, which refers to the density or number of dots of ink. The K Printing Proofer is known in the art. The cells of the Gravure plate pick up bits of ink and deposits the ink on paper to give an image extremely similar to what would be achieved if the ink were jetted through a print head.

The images were partially cured using a UV Fusion LC-6B Benchtop Conveyor equipped with UV Fusion F300S Ultraviolet Lamp System employing a "D" bulb. A single pass at a belt speed of 237 ft/sec provides the following radiative energies: UV A (315-400 nm) 0.5 w/cm$^2$, UV B (280-315 nm) 0.6 w/cm$^2$ and UV C (200-280 nm) 0.1 w/cm$^2$.

The images were then transferred (transfused) to 4024 paper by layering the paper on top of the image bearing aluminum sheet and placing both on a ⅛ inch thick sheet of rubber, such as Viton, and passing this combination through a pair of rollers approximately four inches wide.

The images were completely cured using the same benchtop conveyer. A single pass with a belt speed of 32 ft/sec provides the following radiative energies: UV A (314-400 nm) 1.3 to 1.5 w/cm$^2$, UV B (280-315 nm) 1.0 to 1.4 w/cm$^2$ and UV C (200-180 nm) 0.15 to 0.28 w/cm$^2$.

The partially cured image almost completely (>80%) transfers, even in a crude apparatus. While the completely cured image undergoes very little transfer (<20%). The partially cured, well-transferred image maintained sufficient malleability to partially flow into the paper fibers and could then be completely cured by passing the image on paper through the UV curing station at 32 ft/min to provide a robust well-adhered image.

EXAMPLE 2

The techniques of Example 1 were repeated except that no fuser oil was applied to the aluminum transfer sheet. The results were indistinguishable from the results of Example 1. These results indicate that the transfer is driven by ink rheology and is not dependent on the release oil. Thus, the ability to avoid the use of the release oil simplifies the construction and servicing of the print engine.

While this invention has been described in conjunction with specific embodiments described above, it is evident that many alternatives, modifications and variations will be apparent to those skilled in the art. Accordingly, the preferred embodiments of the invention, as set forth above, are intended to be illustrative and not limiting. Various changes may be made without departing from the spirit and scope of the invention.

What is claimed is:

1. A method of forming an image from a low viscosity ink on a recording medium comprising:

ejecting the low viscosity ink from a printer head in the form of droplets onto an intermediate transfer medium to form the image;

partially curing the image on the intermediate transfer medium;

transferring the partially cured image onto the recording medium; and further curing the partially cured image on the recording medium to create a hardened image, wherein the low viscosity ink comprises a monomer, a photoinitiator and a colorant, and wherein the partially cured image is formed on the intermediate transfer medium by a radiative energy treatment of UV A (315-400 nm) about 0.2 to 0.8 w/cm$^2$, UV B (280-315 nm) about 0.3 to about 1.0 w/cm$^2$ and UV C (200-280 nm) about 0.05 to about 0.5 w/cm$^2$.

2. The method according to claim 1, wherein the low viscosity ink is a radiation curable ink.

3. The method according to claim 1, wherein the radiative energy to create the partially cured image on the intermediate transfer medium is UV A (315-400 nm) about 0.3 to 0.6 w/cm$^2$, UV B (280-315 nm) about 0.4 to about 0.7 w/cm$^2$ and UV C (200-280 nm) about 0.05 to about 0.3 w/cm$^2$.

4. The method according to claim 3, wherein the radiative energy to create the partially cured image on the intermediate transfer medium is UV A (315-400 nm) approximately 0.5 w/cm$^2$, UV B (280-315 nm) approximately 0.6 w/cm$^2$ and UV C (200-280 nm) approximately 0.1 w/cm$^2$.

5. The method according to claim 1, wherein the intermediate transfer medium is coated with a thin layer of oil.

6. The method according to claim 5, wherein the oil is silicon oil.

7. A method of forming an image from a low viscosity ink on a recording medium comprising:

ejecting the low viscosity ink from a printer head in the form of droplets onto an intermediate transfer medium to form the image;

partially curing the image on the intermediate transfer medium;

transferring the partially cured image onto the recording medium; and further curing the partially cured image on the recording medium to create a hardened image, wherein the low viscosity ink comprises a monomer, a photoinitiator and a colorant, and wherein the hardened image is formed by a radiative energy treatment of UV A (314-400 nm) about 0.8 to about 2.0 w/cm$^2$, UV B (280-315 nm) about 0.5 to about 1.8 w/cm$^2$ and UV C (200-180 nm) about 0.05 to about 0.6 w/cm$^2$.

8. The method according to claim 7, wherein the radiative energy to create the hardened image is UV A (314-400 nm) about 1.0 to about 1.8 w/cm$^2$, UV B (280-315 nm) about 0.7 to about 1.6 w/cm$^2$ and UV C (200-180 nm) about 0.1 to about 0.4 w/cm$^2$.

9. The method according to claim 8, wherein the radiative energy to create the hardened image is UV A (314-400 nm) about 1.3 to about 1.5 w/cm$^2$, UV B (280-315 nm) about 1.0 to about 1.4 w/cm$^2$ and UV C (200-180 nm) about 0.15 to about 0.28 w/cm$^2$.

10. The method according to claim 1, wherein the monomer is selected from the group consisting of propoxylated neopentyl glycol diacrylate, diethylene glycol diacrylate, triethylene glycol diacrylate, hexanediol diacrylate, dipropyleneglycol diacrylate, tripropylene glycol diacrylate, alkoxylated neopentyl glycol diacrylate, isodecyl acrylate, tridecyl acrylate, isobornyl acrylate, propoxylated trimethylolpropane triacrylate, ethoxylated trimethylolpropane triacrylate, di-trimethylolpropane tetracarylate, dipentaerythritol pentacarylate and ethoxylated pentaerythritol tetraacrylate.

11. The method according to claim 1, wherein the photoinitiator is selected from the group consisting of 1-hydroxy-cyclohexylphenylketone, benzophenone, 2-benzyl-2-(dimethylamino)-1-(4-(4-morphorlinyl)phenyl)-1-butanone, 2-methyl-1-(4-methylthio)phenyl-2-(4-morphorlinyl)-1-propanone, diphenyl-(2,4,6-trimethylbenzoyl) phospine oxide, phenyl bis(2,4,6-trimethylbenzoyl) phosphine oxide, benzyl-dimethylketal and isopropylthioxanthone.

12. The method according to claim 1, wherein the intermediate transfer medium is substantially free of a thin layer of oil.

13. The method according to claim 1, wherein the low viscosity ink further comprises an oligomer.

14. The method according to claim 13, wherein the oligomer is selected from the group consisting of an epoxy, polyester and polyurethane.

15. The method according to claim 1, wherein the intermediate transfer medium is a transfuse drum or belt.

16. The method according to claim 2, wherein the radiation curable ink is a UV curable ink.

17. The method according to claim 1, wherein the low viscosity ink is cured by an electron beam.

18. The method according to claim 1, wherein the low viscosity ink has a viscosity between about 5 cP and about 20 cP at about 25° C. to about 60° C.

19. The method according to claim 18, wherein the low viscosity ink has a viscosity between about 8 cP and about 13 cP at about 25° C. to about 60° C.

* * * * *